US006533353B2

(12) United States Patent
Johnston

(10) Patent No.: US 6,533,353 B2
(45) Date of Patent: Mar. 18, 2003

(54) LIFT CHAIR WITH ADJUSTABLE ARM RESTS

(76) Inventor: Craig D. Johnston, 924 Center Ave., Bay City, MI (US) 48708

( * ) Notice: Subject to any disclaimer, the term of this patent is extended or adjusted under 35 U.S.C. 154(b) by 0 days.

(21) Appl. No.: 09/772,657

(22) Filed: Jan. 30, 2001

(65) Prior Publication Data

US 2002/0101103 A1 Aug. 1, 2002

(51) Int. Cl.[7] ..... A47C 1/02

(52) U.S. Cl. ..... 297/330; 297/DIG. 10; 297/411.38

(58) Field of Search ..... 297/323, 325, 297/326, 330, DIG. 10, 411.32, 411.35, 411.39, 411.38

(56) References Cited

U.S. PATENT DOCUMENTS

| | | | | | |
|---|---|---|---|---|---|
| 2,869,623 | A | | 1/1959 | Poulin | |
| 3,039,818 | A | | 6/1962 | Frank | |
| 3,596,991 | A | | 8/1971 | McKee et al. | 297/330 |
| 4,244,623 | A | | 1/1981 | Hall et al. | |
| 4,496,190 | A | * | 1/1985 | Barley | 297/411.38 |
| 4,621,864 | A | * | 11/1986 | Hill | 297/411.38 X |
| 4,655,501 | A | * | 4/1987 | Ishigami et al. | 297/411.38 X |
| 4,828,323 | A | * | 5/1989 | Brodersen et al. | 297/411.38 X |
| 5,242,138 | A | | 9/1993 | Kornberg | 297/411.38 |
| 5,489,143 | A | * | 2/1996 | Adachi et al. | 297/411.38 |
| 5,558,404 | A | | 9/1996 | Muzzy et al. | |
| 5,597,209 | A | * | 1/1997 | Bart et al. | 297/411.38 |
| 5,702,157 | A | * | 12/1997 | Hurite | 297/411.38 |
| 5,730,494 | A | | 3/1998 | LaPointe et al. | 297/330 |
| 5,931,532 | A | | 8/1999 | Kemmerer et al. | 297/330 |
| 5,941,603 | A | * | 8/1999 | Wein | 297/411.38 X |
| 5,984,408 | A | | 11/1999 | Bujaryn | 297/323 |
| 5,984,416 | A | | 11/1999 | Waldo et al. | 297/411.35 X |
| 6,050,645 | A | * | 4/2000 | Bradbury | 297/411.38 |
| 6,183,046 | B1 | * | 2/2001 | Wiloughby | 297/411.38 |
| 6,250,717 | B1 | * | 6/2001 | Porcheron | 297/411.35 X |

* cited by examiner

*Primary Examiner*—Peter M. Cuomo
*Assistant Examiner*—Rodney B. White
(74) *Attorney, Agent, or Firm*—Reising, Ethington, Barnes, Kisselle, Learman & McCulloch, P.C.

(57) ABSTRACT

The lift chair has a chair fame pivotally connected to a chair base for pivotal movement about a chair frame horizontal axis. A liner actuator pivots the chair frame about a chair frame horizontal axis. Left and right arm rests are pivotally attached to the chair frame by hinge and ratchet assemblies. The hinge portions have an arm rest axis at the rear of the arm rests. The ratchet portion permit forward ends of the arm rests to be raised as required and hold the arm rests in selected positions to assist a person to stand after the chair frame has been pivoted upward about the chair frame horizontal axis. The arm rests are pivoted to their upper limit to release the ratchet assemblies and free the arm rests to pivot to their lower positions.

6 Claims, 3 Drawing Sheets

LIFT CHAIR WITH ADJUSTABLE ARM RESTS

TECHNICAL FIELD

The invention is in a lift chair, for physically challenged individuals, with arm rests that are pivotally adjustable to assist an individual in assuming a standing position.

BACKGROUND OF THE INVENTION

Lift chairs for lifting physically challenged individuals from a sitting position to a standing position are well known. These chairs are generally well padded easy chairs with arm rest. The lifting mechanisms employed vary substantially. There are some lift chairs that manipulate the seat cushion only. Other chairs lift only the arm rests vertically upward. Lifting the arm rests only works for an individual that has substantial upper body strength. Moving the arms to a higher position helps a person lift his body onto his feet with his arms.

A more common lift chair has a chair frame that is pivotally attached to a support base. The chair frame is pivoted relative to the support base about an axis at the front of the chair and adjacent to the floor. A variety of power lift mechanisms have been employed to pivot the chair frame of these lift chairs relative to the base. The power lift mechanisms include rotatable screws and fluid cylinders. Some of the mechanisms are manually powered while others are electrically powered.

Pivoting a chair frame upward about a horizontal axis below the forward edge of a seat cushion causes the arm rests to pivot with the chair frame. The forward ends of the arm rests move forward and downward toward the floor. The rear ends of the arm rests move upward away from the floor and forward. At the same time a persons trunk is raise and moved forward relative to his or her feet. The end result is that the portions of arm rests that a person would push against with his hands to move to a standing position moves to an angle in which it slopes downward and forward and also moves away from his or her shoulders. In this arm rest position the use of a person's arms and upper body to move to a standing position is rendered more difficult and less effective for many individuals.

Padded wide arm rests are difficult to grasp. A person with minimal grip strength may find it almost impossible to grip such an arm rest. When a padded wide arm rest is covered by a material with a relatively slick or smooth surface, a person with substantial grip strength may find that his hands slip on the arm rest rather than helping to lift his body to a standing position. The fact that the smooth surfaces of arm rests on some lift chairs also slope forwardly and downwardly makes it difficult for individuals, that rely on upper body strength, to move from a sitting position to a standing position.

SUMMARY OF THE INVENTION

The lift chair has a chair base. A chair frame is pivotally attached to the chair base for pivotal movement about a horizontal frame axis. The frame axis is positioned adjacent to a lower forward portion of the chair frame. A seat pad and backrest pad are connected to the chair frame. A linear actuator is connected to the chair base and to the chair frame for pivoting the chair frame about the horizontal frame axis between a seat pad lowered position and a seat pad raised position. Left and right hinge and ratchet assemblies have anchor arms fixed to the chair frame. Adjustable arms are pivotally attached to the anchor arms by hinge pins for pivotal movement about an arm rest axis. Each hinge and ratchet assembly includes a pivoted bolt that is engageable with a plurality of ratchet teeth to hold an adjacent arm in a selected position and to limit pivotal movement of an adjustable arm to a lower position. Bolt lockouts inactivate the bolts to permit pivotal movement of the adjustable arms to a lowered position. A left arm rest is attached to one of the adjustable arms with its rear end adjacent to the arm rest axis. A right arm rest is attached to the other adjustable arm with its rear end adjacent to the other adjustable arm.

The ratchet assemblies permit the arm rests to be pivoted to positions in which they are horizontal when the seat cushion is in a raised position. The arm rests can be used to provide assistance in moving to a standing position when the arm rests are in a raised horizontal position.

DESCRIPTION OF THE DRAWINGS

The presently preferred embodiment of the invention is discloses in the following description and in the accompanying drawings, wherein.

DETAILED DESCRIPTION OF THE PREFERRED EMBODIMENT

Figure 1:
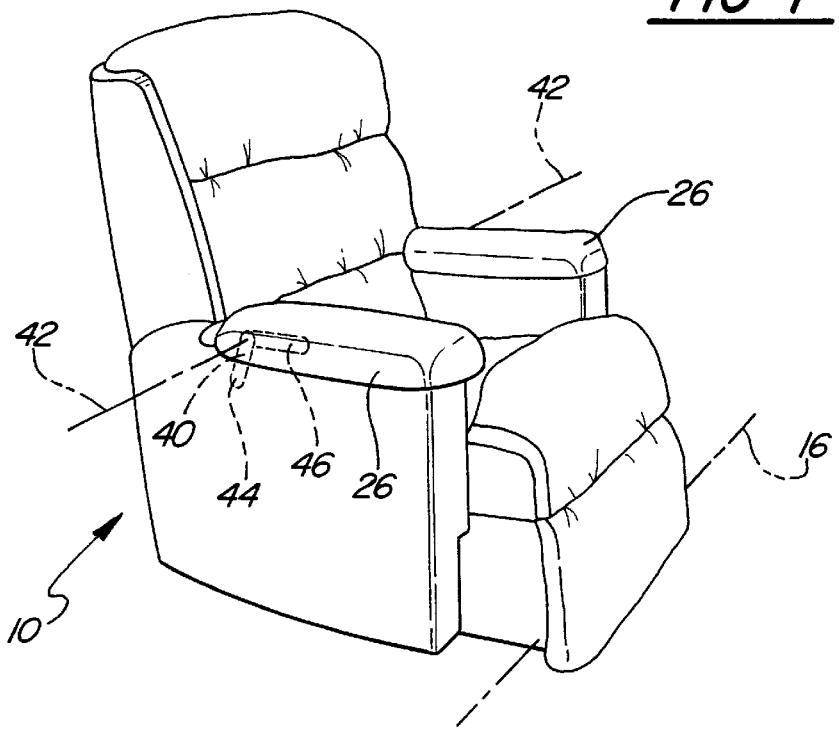
FIG. 1 is a perspective view of a lift chair, with adjustable arm rests, in a lowered position for sitting.

The lift chair 10 has a chair frame 12. The chair frame 12 is pivotally connected to a chair base 14 for pivotal movement about a horizontal frame axis 16. A seat pad 18 and a backrest pad 20 are attached to the chair frame 12. Two arm rests 22 and 24 are also attached to the chair frame 12. A wide covered pad 26 is fixed to the upper portion of each of the arm rests 22 and 24.

Exposed surfaces of the chair frame 12 are covered by a cover 28. Padding may be provided between the chair frame 12 and the cover 28 if desired. The cover for the chair frame 12 can be a fabric material, leather, plastic or other suitable material. The cover for the seat pad 18, the backrest pad and the arm rest pads 26 can be fabric, leather, plastic or other suitable material.

Figure 2:
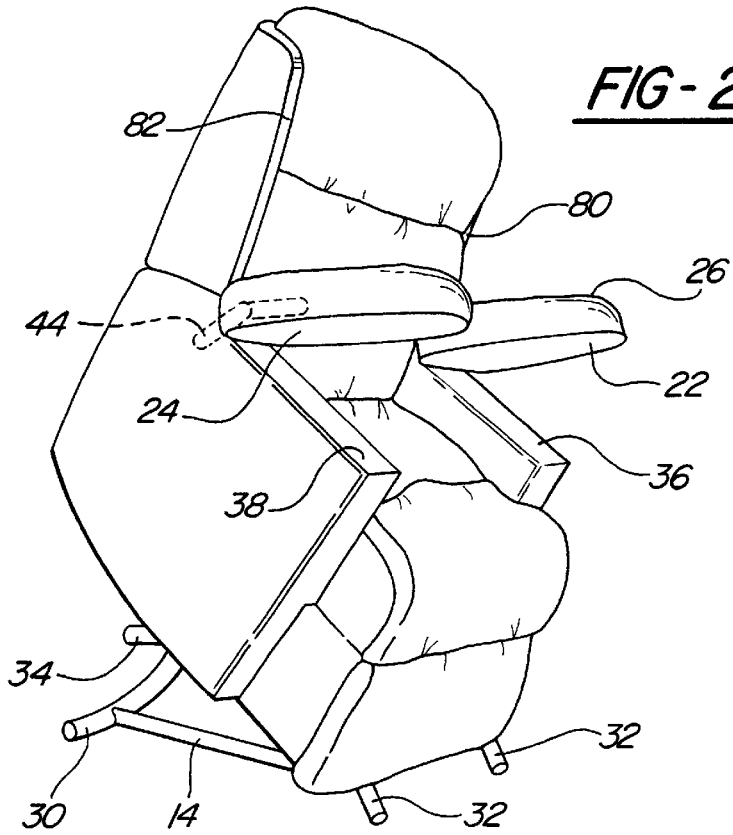
FIG. 2 is a perspective view of the lift chair with both the chair and the arm rests in raised positions.

The chair base 14 is a metal frame. Two rear floor contact legs 30 and two front floor contact legs 32 are integral parts of the chair base 14. Only the right rear floor contact leg 30 is shown in FIG. 2. The chair base 14 is symmetrical about a central fore and aft vertical plane. The left rear floor contact leg 30 is therefore substantially identical to the right rear leg 30 that is shown. Additional legs can be provided if desired.

A linear actuator 34 is pivotally attached to the chair base 14 and the chair frame 12 in a known manner. Hydraulic linear actuators as well as screw type linear actuators are used on lift chairs 10. Both types of linear actuators 34 are operated electrically on modern chairs. These actuators 34 pivot the chair frame 12 about the axis 16. Preferably the tilt position is positively controlled in both directions by the actuator 34.

The left and right arm rests 22 and 24 are pivotally attached to the chair frame 12 by hinge and ratchet assemblies 40. These assemblies 40 provide a horizontal arm rest axis 42 at the rear edge of each arm rest 22 or 24. In the normal use position the arm rests 22 and 24 rest upon arm rest support surfaces 36 and 38 on the chair frame 12. The ratchet assemblies 40 have an anchored arm 44 and an adjustable arm 46. The anchored arms 44 are fastened to the chair frame 12 by mechanical fasteners such as screws or bolts at the rear of the arm rest support surfaces 36 and 38 and inside the frame 12. The adjustable arms 46 are received in slots in the rear lower portions of the arm rests 22 and 24 as shown in FIGS. 1 and 2. Mechanical fasteners secure the arm rests 22 and 24 to the adjustable arms 46. Both ratchet assemblies 40 are inside components of the chair frame 12 and the arm rests 22 and 24 and are not seen in a complete chair 10. The ratchet assembly 40 in the arm rest 22 is in the same position as the ratchet assembly in the arm rest 24. The hinge and ratchet assembly 40, adjacent to the arm rest support surface 36 and secured to the arm rest 22, is not shown in FIG. 1 or 2.

Figure 6:
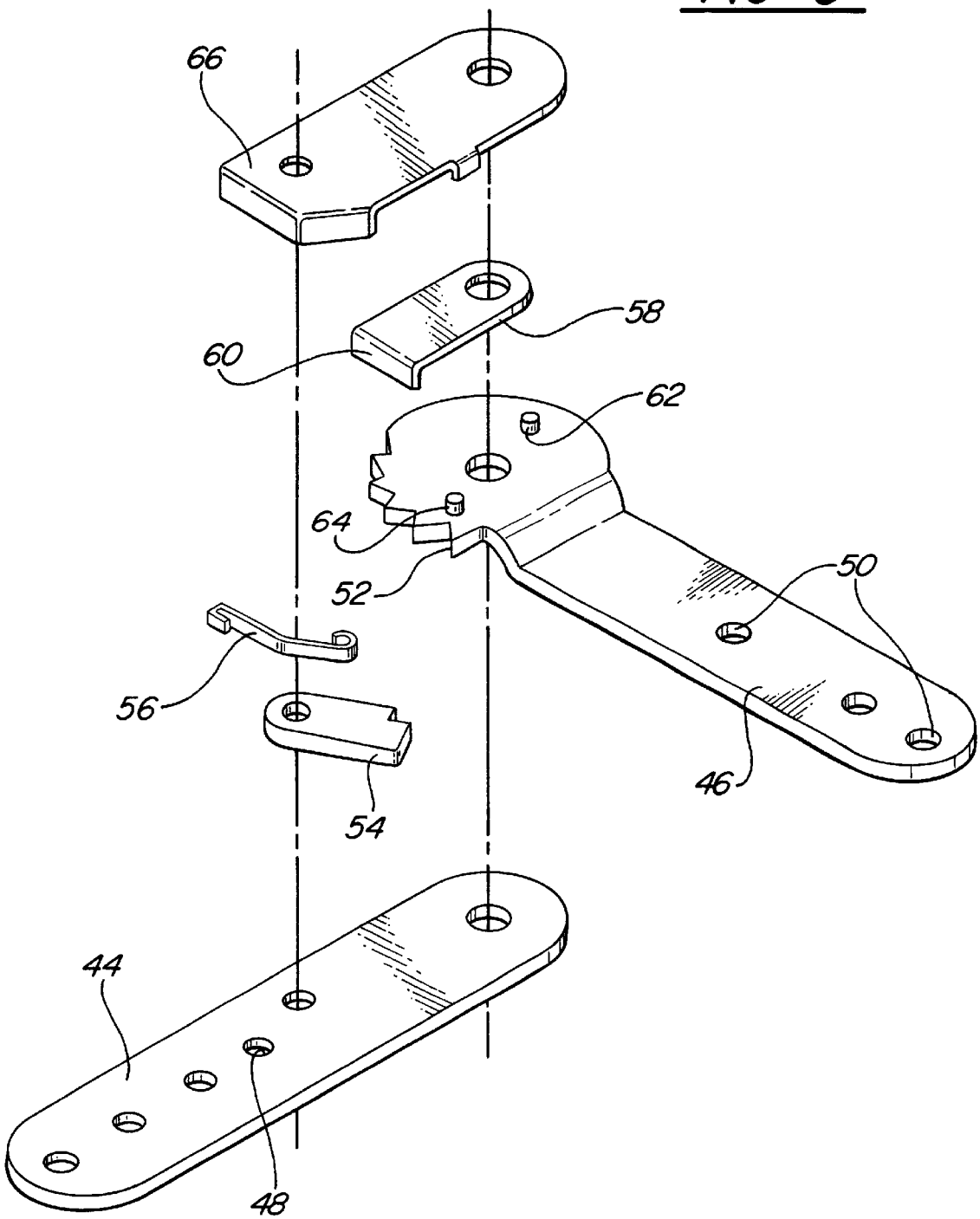
FIG. 6 is an expanded view of the pivot and ratchet mechanism.

The ratchet assemblies 40 as shown in FIG. 6 have an anchor arm 44 and an adjustable arm 46. The anchor arm 44 has four mounting bores 48 for fasteners that attach the anchor arm to the chair frame 12. The adjustable arm 46 has three mounting bores 50 for attaching the arm rests 22 and 24 to the adjustable arms 46. The adjustable arm 46 includes a series of ratchet teeth 52. The number of teeth 52 is optional. However five teeth 52 as shown provides a down position and four raised positions and is believed to be satisfactory. The pivoted bolt 54 engages the teeth 52 to hold an arm rest 22 or 24 in a raised position. A spring 56 biases the pivoted bolt 54 toward the teeth 52. An L-shaped bolt lockout 58 extends radially outward from the arm rest axis 42. A short leg 60 of the bolt lockout 58 is adjacent to the ratchet teeth 52. A bolt lockout pin 62 on the adjustable arm 46 engages the L-shaped bolt lockout 58 and forces the short leg 60 between the pivoted bolt 54 and the ratchet teeth 52. A bolt lockout release pin 64 engages the L-shaped bolt lockout 58 and forces the short leg 60 from between the pivoted bolt 54 and the ratchet teeth 52 thereby freeing the bolt to be forced into engagement with a rack tooth 52 for the lower most position. A ratchet assembly cover 66 encases the pivoted bolt 54 and the L-shaped bolt lockout.

The ratchet assembly cover 66 of each of the hinge and ratchet assemblies 40 faces toward the right side of the lift chair 10 during use. The spring 56 biases the pivoted bolt in a counter clockwise direction as viewed from the right side when looking toward the left side. The adjustable arm 46 moves clockwise to a lowered position as seen from the right side.

Figure 5:
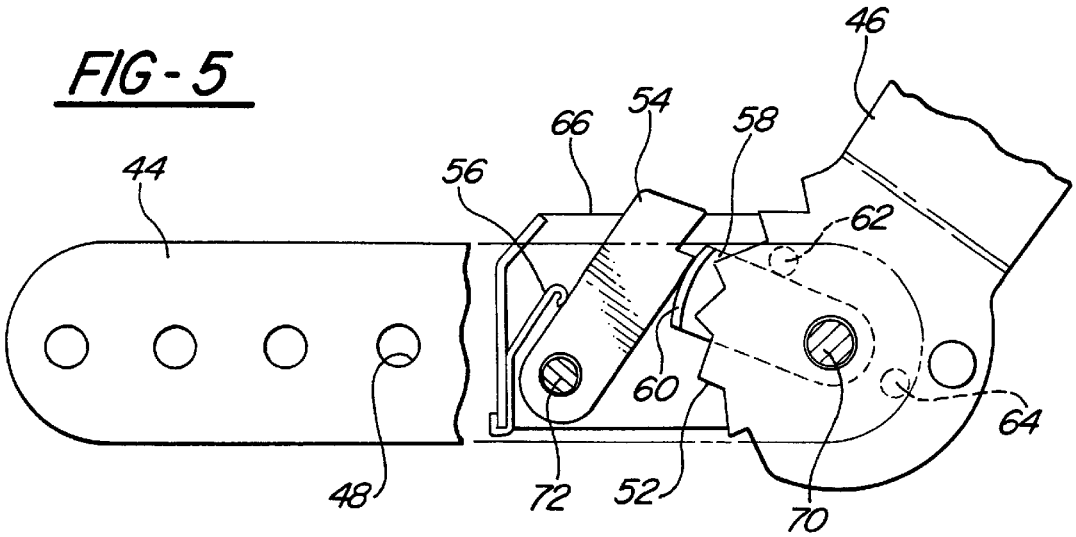
FIG. 5 is an elevational view of the pivot and ratchet mechanism in a raised position with the ratchet pivoted bolt held in a released position.

During operation an arm rest 22 or 24 is lowered into contact with the arm rest support surface 36 or 38 and the bolt lockout release pin 64 moves the L-shaped bolt lockout out of engagement with the pivoted bolt 54. FIG. 5 shows the adjustable arm 46 moving counter clockwise, the bolt lock release pin 64 engaging the L-shaped bolt lockout 58 and starting to move the bolt lockout out of locking engagement with the bolt. Note that the hinge and ratchet assembly is viewed from the left side in FIG. 5 and rotated 90° clockwise from the position shown in FIGS. 1 and 2.

Figure 3:
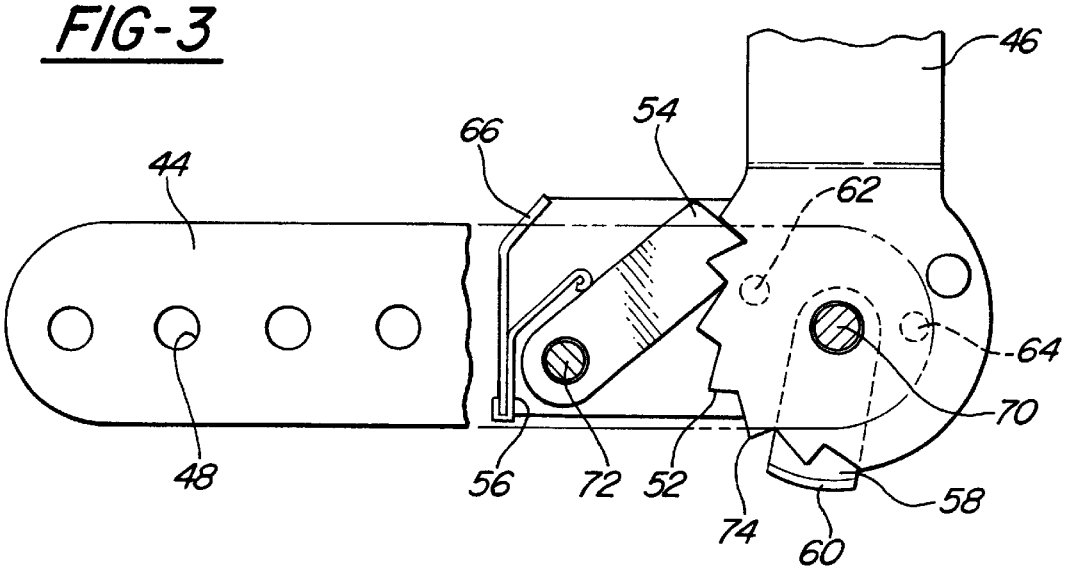
FIG. 3 is a side elevational view of an arm rest pivot and ratchet mechanism, with parts broken away, in a lowered position.

Movement of the adjustable arm 46 counter clockwise about the axis of the hinge pin 70 causes the bolt lockout pin 62 to move the L-shaped bolt lockout 58 out of contact with the bolt 54. As soon as the bolt lockout 58 disengages the bolt 54, the spring 56 pivots the bolt 54 clockwise about the bolt pin 72 and into engagement with the teeth 52 as shown in FIG. 3. In the position shown in FIG. 3, the arm rest 22 or 24 is in contact with an adjacent arm rest support surface 36 or 38.

The arm rests 22 and 24 are raised manually from the positions shown in FIG. 1 to positions shown in FIG. 2 which will position the arm rests in a generally horizontal position when the chair frame 12 is pivoted about the axis 16 to a raised position as shown in FIG. 2. With the arm rests 22 and 24 in the raised horizontal position, a challenged individual can make maximum use of his upper body and arms to rise to a standing position.

Figure 4:
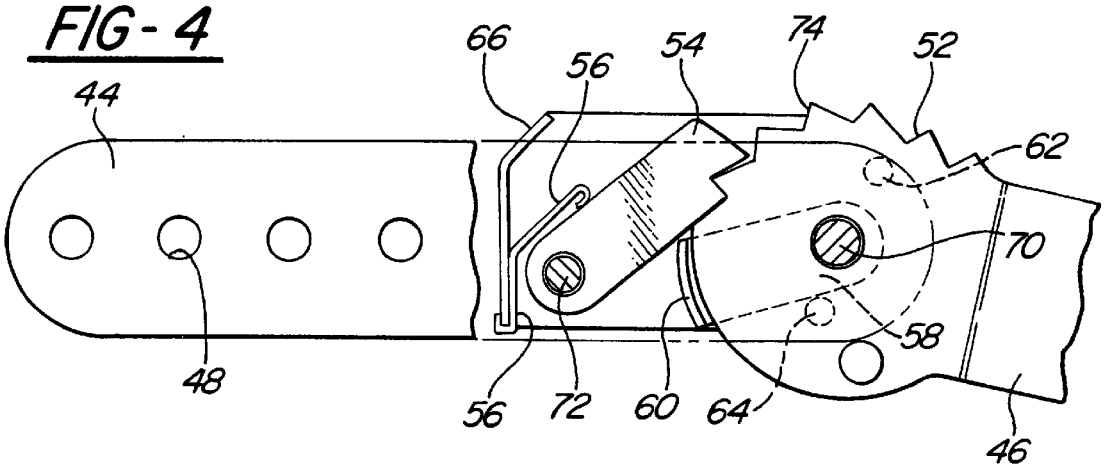
FIG. 4 is an elevational view of the pivot and ratchet mechanism, in a fully raised position, with parts broken away.

Movement of the forward ends of the arm rests 22 or 24 upward manually moves the adjustable arm 46 clockwise from the position shown in FIG. 3 toward the position shown in FIG. 4. The points 74 of the ratchet teeth 52 cam the bolt 54 counter clockwise about the bolt pin 72. The spring 56 forces the bolt 54 back into contact with each ratchet tooth 52. An individual can stop raising the front of the arm rests 22 and 24 with the bolt 54 in contact with any chosen ratchet tooth 52. Engagement between a tooth 52 and a pivoted bolt 54 prevents counter clockwise rotation of the adjustable arm 46 about the hinge pin 70 as shown in FIGS. 3 and 4.

The adjustable arm 46 is in a fully raised position in FIG. 4. In this position the arm rests 22 and 24 provide surfaces that an individual can employ to raise to a standing position. In the raised position the arm rests 22 and 24 can assist a person to assume a sitting position.

The arm rests 22 and 24 are returned to the normal use position shown in FIG. 1 by moving the adjustable arm 46 clockwise from the position shown in FIG. 4. The upward and rearward sloping surfaces 80 and 82 of the chair frame 12 provide space for the arm rests 22 and 24 to move upward and rearward from the position shown in FIG. 2. This movement moves the adjustable arm 46 clockwise from the position shown in FIG. 4. This clockwise movement of the adjustable arm 46 moves the bolt lockout release pin 64 into engagement with the L-shaped bolt lockout 58, pivots the bolt lockout about the hinge pin 70 and moves the short leg 60 into a position in which the pivoted bolt 54 is held out of contact with the ratchet teeth 52 as shown in FIG. 5. In this position the bolt 54 leaves the adjustable arm 46 free to move into the position shown in FIG. 3 and with the arm rests 22 and 24 in the position shown in FIG. 1 as described above.

The disclosed embodiment is representative of a presently preferred form of the invention, but is intended to be illustrative rather than definitive thereof. The invention is defined in the claims.

What is claimed is:

1. A lift chair comprising:

a chair base;

a chair frame pivotally attached to said chair base for pivotal movement about a horizontal frame axis positioned adjacent to a lower forward position of the chair frame;

a seat pad and a backrest pad connected to the chair frame;

an actuator connected to said chair base and to the chair frame for pivoting the chair frame about said horizontal frame axis;

a left hinge assembly pivotally connecting a left arm rest to the chair frame for pivotal movement about a single horizontal arm rest axis adjacent to a left arm rest rear portion and including a plurality of left ratchet teeth;

a left arm rest with a left arm rest rear end attached to the left hinge assembly;

a right hinge assembly pivotally connecting a right arm rest to the chair frame for pivotal movement about said single horizontal arm rest axis adjacent to a right arm rest rear portion and including a plurality of right ratchet teeth;

a right arm rest with a right arm rest rear end attached to the right hinge assembly;

a left bolt assembly connected to the left hinge assembly and including a left bolt spring biased toward engagement with the plurality of left ratchet teeth to hold the left arm rest in selected positions about said single horizontal arm rest axis;

a right bolt assembly connected to the right hinge assembly and including a right bolt spring biased toward engagement with the plurality of right ratchet teeth to hold the right arm rest in selected positions about said single horizontal arm rest axis;

a left bolt lockout pivotally mounted on the left hinge assembly for pivotal movement about said single horizontal arm rest axis, a left bolt lockout pin attached to the left hinge assembly that forces the left bolt lockout into a left bolt lockout position in which the left bolt is held out of contact with the left ratchet teeth, and a left bolt lockout release pin attached to the left hinge assembly that forces the left bolt lockout into a left bolt unlocked position in which the left bolt is freed to engage the plurality of left ratchet teeth;

a right bolt lockout pivotally mounted on the right hinge assembly for pivotal movement about said single horizontal arm rest axis, a right bolt lockout pin attached to the right hinge assembly that forces the right bolt lockout into a right bolt lockout position in which the right bolt is held out of contact with the right ratchet teeth, and a right bolt lockout release pin attached to the right hinge assembly that forces the right bolt lockout into a right bolt unlocked position in which the right bolt is freed to engage the plurality of right ratchet teeth;

wherein a left arm rest forward end is raised manually to a left arm rest upper position to pivot the left bolt lockout into the left bolt lockout position and the left arm rest forward end is lowered manually to the left bolt unlocked position; and wherein a right arm rest forward end is raised manually to a right arm rest upper position to pivot the right bolt lockout into the right bolt lockout position, and the right arm rest forward end is lowered manually to the right bolt unlocked position.

2. A lift chair as set forth in claim 1 wherein the left hinge assembly includes a left adjustable arm that is pivotal about said arm rest axis, the left bolt lockout pin is mounted on the left adjustable arm and the left bolt lockout release pin is mounted on the left adjustable arm; and wherein the right hinge assembly includes a right adjustable arm that is pivotal about said arm rest axis, the right bolt lockout pin is mounted on the right adjustable arm and the right bolt lockout release pin is mounted on the right adjustable arm.

3. A lift chair comprising:

a chair base;

a chair frame pivotally attached to said chair base for pivotal movement about a horizontal frame axis positioned adjacent to a lower forward portion of the chair frame;

a seat pad and a backrest pad connected to the chair frame;

a linear actuator connected to said chair base and to the chair frame for pivoting the chair frame about said horizontal frame axis between a seat pad lowered position and a seat pad raised position;

a left hinge and ratchet assembly having a left anchor arm fixed to the chair frame, a left adjustable arm pivotally attached to the left anchor arm by a left hinge pin for pivotal movement about a single arm rest axis, a left bolt engageable with a plurality of left ratchet teeth to hold the left adjustable arm in a left adjustable arm selected position and to limit pivotal movement of the left adjustable arm in a first direction while permitting movement in a second direction, and a left bolt lockout pivotally attached to the left hinge assembly, for pivotal movement about said single arm rest axis, that inactivates the left bolt to permit pivotal movement of the left adjustable arm in the first direction;

a right hinge and ratchet assembly having a right anchor arm fixed to the chair frame, a right adjustable arm pivotally attached to the right anchor arm by a right hinge pin for pivotal movement about said single arm rest axis, a right bolt engageable with a plurality of right ratchet teeth to hold the right adjustable arm in a right adjustable arm selected position and to limit pivotal movement of the right adjustable arm in the first direction while permitting movement in the second direction, and a right bolt lockout pivotally attached to the right hinge assembly for pivotal movement about said single arm rest axis, that inactivates the right bolt to permit pivotal movement of the right adjustable arm in the first direction;

a left arm rest attached to the left adjustable arm and having a left arm rear end that is adjacent to said arm rest axis and a left arm rest forward end that is pivotal about said arm rest axis with the left adjustable arm;

a right arm rest attached to the right adjustable arm and having a right arm rest rear end that is adjacent to said arm rest axis and a right arm rest forward end that is pivotal about said arm rest axis with the right adjustable arm;

a left bolt lockout pin attached to the left hinge and ratchet assembly that forces the left bolt lockout into a left bolt lockout position in response to manual lifting of the left arm rest forward end, and a left bolt lockout release pin attached to the left hinge and ratchet assembly that forces the left bolt lockout into a left bolt unlocked position in response to manual lowering of the left arm rest forward end; and a right bolt lockout pin attached to the right hinge and ratchet assembly that forces the right bolt lockout into a right bolt lockout position in response to manual lifting of the right arm rest forward end, and a right bolt lockout release pin attached to the right hinge and ratchet assembly that forces the right bolt lockout into a right bolt unlocked position in response to manual lowering of the right arm rest forward end.

4. A lift chair as set forth in claim 3 including a left arm rest support surface on the chair frame that contacts the left arm rest to limit pivotal movement of the left arm rest in the first direction; and a right arm rest support surface on the chair frame that contacts the right arm rest to limit pivotal movement of the right arm rest in the first direction.

5. A method of dismounting from a lift chair comprising:

pivoting a left arm rest about a single horizontal arm rest axis to raise a left arm rest forward end;

locking the left arm rest in a selected position;

pivoting a right arm rest about said single horizontal arm rest axis to raise a right arm rest forward end;

locking the right arm rest in a selected position;

pivoting a chair frame about a horizontal chair frame axis and relative to a chair base to raise a chair seat pad and a trunk of a person that is dismounting from the lift chair while simultaneously pivoting the left and right arm rests toward horizontal positions;

engaging the generally horizontal left and right arm rests by the persons;

exerting a downward force on the left and right arm rests to move off the chair seat and to a standing position;

pivoting the chair frame about said chair frame horizontal axis to return the lift chair to a position for sitting;

raising a forward end of the left arm rest upward to pivot a left bolt lockout about said single horizontal arm rest axis and holding a left arm rest bolt in a left bolt lockout position;

lowering the forward end of the left arm rest;

raising a forward end of the right arm rest upward to pivot a right bolt lockout about said single horizontal arm rest axis and holding a right arm rest bolt in a right bolt lockout position; and lowering the forward end of the right arm rest.

6. A method of dismounting from a lift chair as set forth in claim 5 including:

pivoting the left bolt lockout about said single horizontal axis to a left bolt released position; and pivoting the right bolt lockout about said single horizontal axis to a right bolt released position.

* * * * *